US006139441A

United States Patent [19]

Fairchild

[11] Patent Number: 6,139,441

[45] Date of Patent: Oct. 31, 2000

[54] AUTOMATIC GOLF BALL TEEING DEVICE

[76] Inventor: Richard J. Fairchild, 1133½ Grove St., Apt. 3, Clearwater, Fla. 33755

[21] Appl. No.: 09/370,146

[22] Filed: Aug. 9, 1999

[51] Int. Cl.[7] ..... A63B 57/00

[52] U.S. Cl. ..... 473/134; 473/136

[58] Field of Search ..... 473/132–137

[56] References Cited

U.S. PATENT DOCUMENTS

| | | | |
|---|---|---|---|
| 2,675,237 | 4/1954 | Willcox | 473/136 |
| 3,758,118 | 9/1973 | Wilcox . | |
| 4,265,453 | 5/1981 | Loof . | |
| 4,360,204 | 11/1982 | Karr | 473/137 |
| 5,282,628 | 2/1994 | Komori et al. . | |
| 5,415,409 | 5/1995 | Hellman . | |
| 5,464,223 | 11/1995 | Dermott . | |
| 5,529,307 | 6/1996 | Chang | 473/136 |
| 5,580,318 | 12/1996 | Weber . | |
| 5,647,805 | 7/1997 | Tarbox . | |
| 5,665,004 | 9/1997 | Vishovic . | |
| 5,674,130 | 10/1997 | Egan . | |
| 5,704,844 | 1/1998 | Luther . | |
| 5,860,870 | 1/1999 | Park | 473/136 |
| 5,895,325 | 4/1999 | Tomey . | |

*Primary Examiner*—Steven Wong
*Attorney, Agent, or Firm*—Harold D. Shall

[57] ABSTRACT

A golf ball teeing device includes a rotatable shaft driven through an approximately 180 degree arc by a forwardly and reversely rotating motor. A pair of flexible and parallel arms are mounted on the shaft with an end projecting therefrom. The ends of the arms when in a first position opposed to the tee, secure a ball therebetween from a ramp supply of balls. At this time a forward and reversing switch causes the motor to reverse thereby moving the arms approximately 180 degrees to place the ball on the tee.

5 Claims, 4 Drawing Sheets

AUTOMATIC GOLF BALL TEEING DEVICE

BACKGROUND OF THE INVENTION

1. Field of the Invention

This invention relates generally to golf ball teeing devices and more particularly to a compact device for delivering golf balls on to a golf ball tee.

2. Brief Description of the Prior Art

Golf ball teeing devices for use at golf driving ranges are well known in the prior art and are exemplified by devices as shown in U.S. Pat. Nos. 5,580,318; 5,895,325 and 5,704,844. They all have in common the movement of a ball from a ball storage area and an arrangement for placing such a ball on a fixed tee where the user can strike the ball with a golf club. These prior devices are large and cumbersome, as exemplified by the above prior art patents and have a substantial protrusion into the area surrounding the tee, and have complex structure and operation. Additionally they do not have a control system which responds to various position and conditions of the teeing device as does the device of this invention.

SUMMARY OF THE INVENTION

The present invention includes a shaft rotably mounted on a support adjacent the tee, a forwardly and reversely rotating motor driving the shaft, a bifurcated arm, or pair of parallel arms, carried on the shaft for rotation therewith. The ends of the arms, upon rotation of the shaft in a first direction opposed to the tee, resiliently secured a ball therebetween from a ball supply ramp. At this time a control device causes the motor to reverse thereby moving the arms 180 degrees to place the ball on top of the tee; there being a spreading device to separate the arms at this time whereby the ball is deposited on the tee. The control system includes a control device for changing the rotation of the shaft, a presence sensor control for sensing when a ball is on the tee and stopping shaft rotation and so that when a ball is struck and no longer on the tee, the shaft will be conditioned for rotation in the opposite direction, a control device for conditioning the shaft to reverse rotation at the end of each of its rotating operations, a chute to deliver the next ball to the pickup location at the end of the shaft rotation in the opposite direction whereby the arms resiliently grasp the ball therebetween, and a spreader device to separate the arms when the ball is at the tee whereby the ball is properly delivered to the tee. The structure as hereinafter described requires no equipment protruding in the area of the tee. The shaft, motor and there components except for the tee and arms can be below the surface adjacent the tee, with only a slot through which the arms may move being present adjacent the tee.

DESCRIPTION OF THE PREFERRED EMBODIMENT

Figure 1:
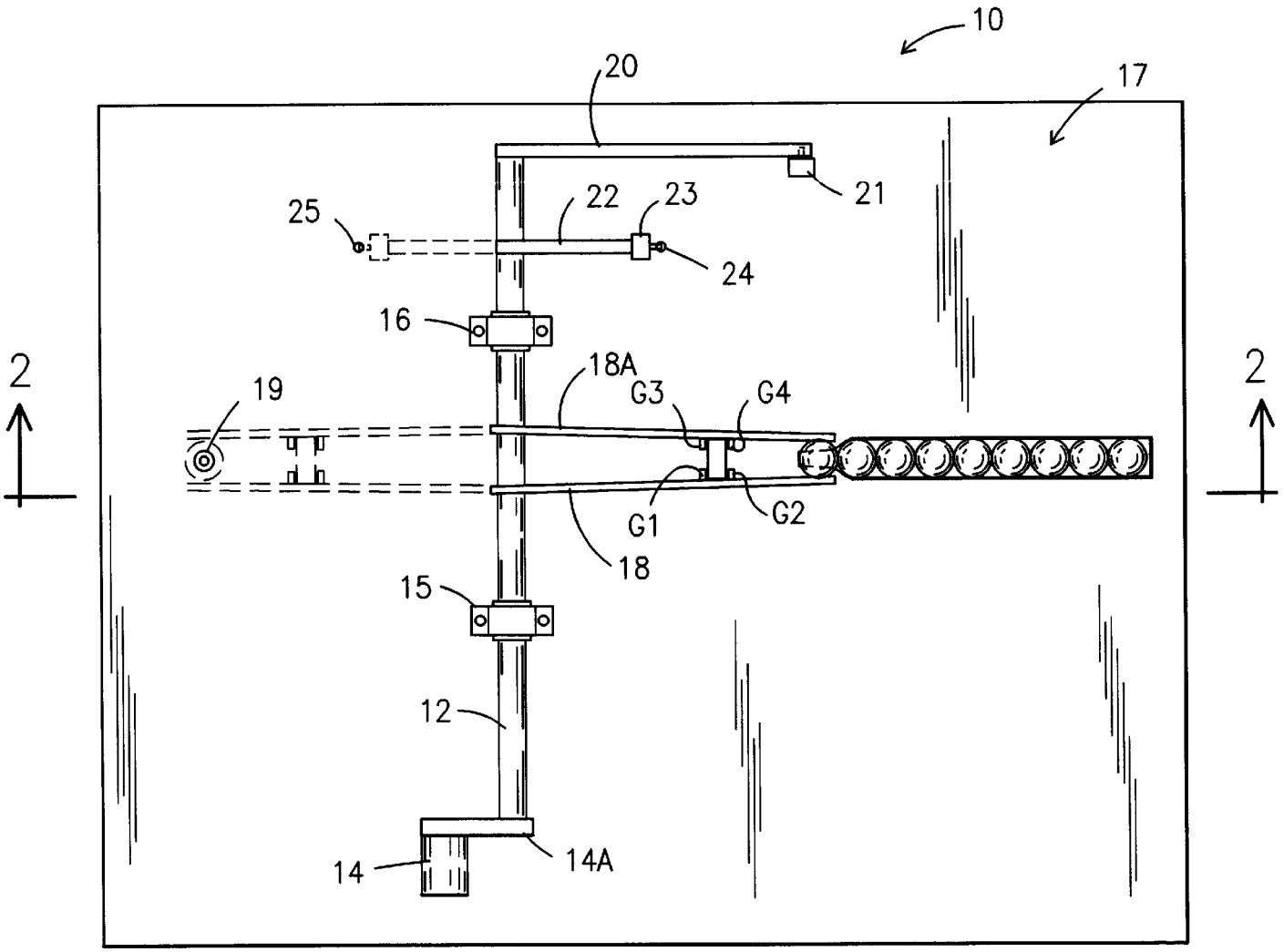
FIG. 1 is a plan view of the teeing device of this invention with the control system omitted.
Figure 2:
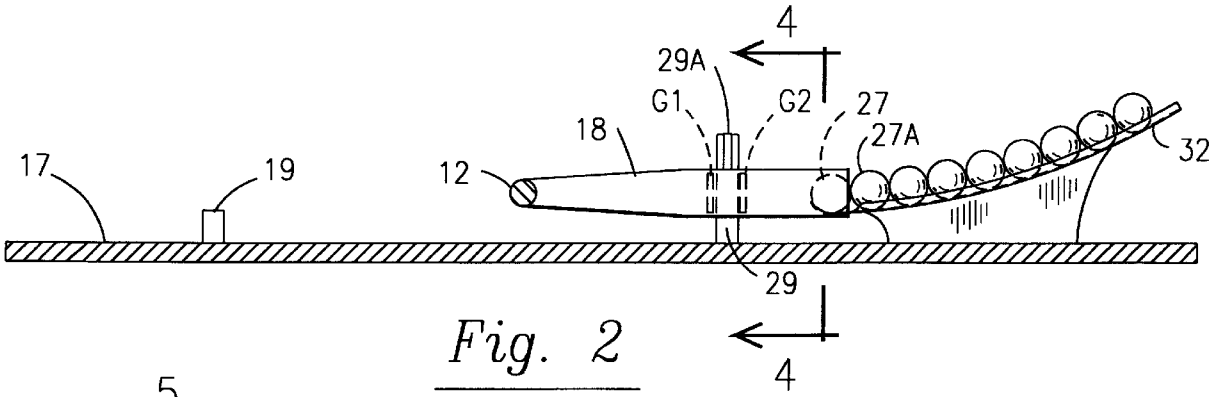
FIG. 2 is a cross sectional view taken along lines 2—2 in FIG. 1 showing the arms grasping a selected ball.
Figure 3:
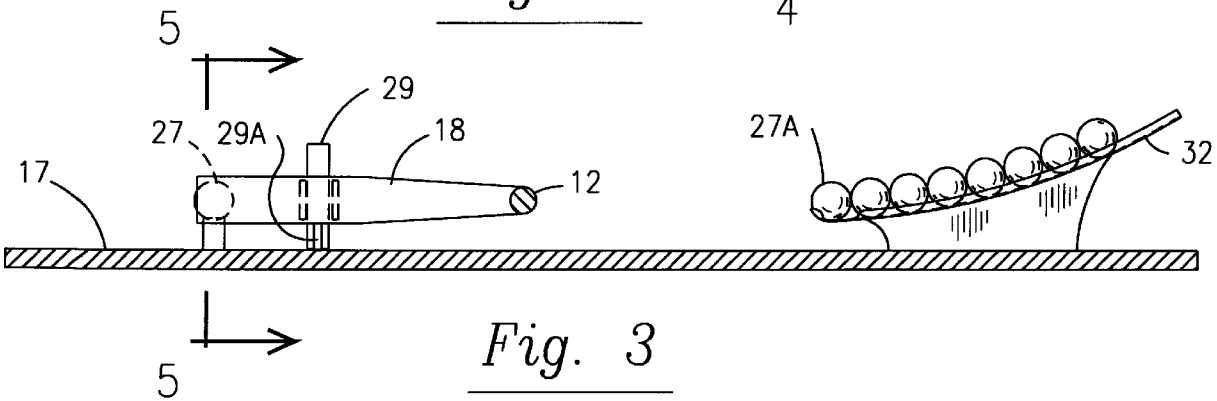
FIG. 3 is a cross sectional taken like FIG. 2 only with the arm rotated to a position to deposit the selected ball on a tee.

As seen in FIGS. 1–5 a ball teeing device shown generally at 10 includes a rotatable shaft 12, a forward and reverse motor 14 and transmission 14*a* for rotating the shaft, a pair of spaced bearing containing conventional pillow blocks 15 and 16 secured to and rotably mounting the shaft 12 on a supporting surface 17, a pair of laterally spaced grasping arms 18 and 18A secured to the shaft 12 intermediate the pillow blocks 15 and 16 for unitary rotation with the shaft through substantially 180 degrees of rotation, a tee 19 carried by the supporting surface 17 and positioned whereby the arms 18 and 18*a* can deposit a ball thereon, a switch arm 20 carried by the end of the shaft 12 and rotable therewith, a switch 21 actuable by the switch arm 20, the switch 21 being a normally closed switch carried by the support surface 17 and being actuated to an open condition when contacted by the end of the switch arm 20, but only as long as it is contacted, and a switch carrying arm 22 having a forward and reversing switch 23 thereon with the actuating toggle of the switch engagable with an abutment 24 when in the position shown in FIG. 1 and engagable with the abutment 25 when the shaft 12 is rotated oppositely to the position of FIG. 3. The control system shown generally at 26 in FIG. 6 will be hereinafter described as will the alternate embodiments of elements thereof shown in FIGS. 7 and 8.

Figure 5:
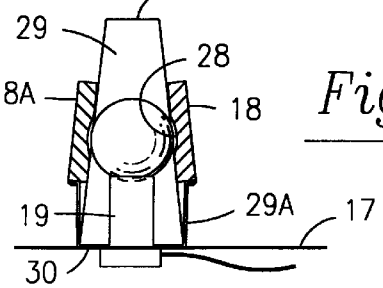
FIGS. 4 and 5 are cross sectional views taken along the lines 4—4 in FIG. 2 and 5—5 in FIG. 3, respectively.
Figure 4:
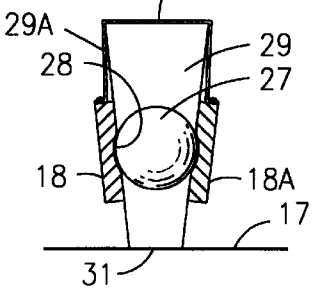

Referring now to FIG. 2, the shaft 12 has rotated clockwise so that the arms 18 and 18A are in a position to grasp the next in line ball 27 therebetween, as seen in FIG. 4. The arms 18 and 18A are made of a resilient flexible material, such as a steel referred to as spring steel, and at the location of the ball position, each has a concave depression 28 on the inner surface thereof with the open end facing inwardly so that the ball 27 may be nested therebetween. Referring momentarily to FIG. 4 along with FIG. 2, the arms 18 and 18A carry a spreading device 29 for alternately allowing the arms to flex toward each other and grasp a ball therebetween and for spreading the arms 18 and 18A apart when the ball is over the tee to thereby deposit the ball on the tee. While many spreading devices can be utilized, a simple and operative device is shown at 29, which device in the fore and aft direction shown in FIGS. 2 and 3, is a block which is rectangular in cross section when viewed in these Figs., and when viewed in FIGS. 4 and 5, are trapezoidal in cross section having a wide base 30 and a narrow base 31 and an attitude which is greater than the width of the arms 18 and 18A, and with, as seen in FIG. 4, the wider base 30 at the top and, as seen in FIG. 5, the wider base 30 at the bottom and the narrow base at the top. The particular base 30 or 31 which is "down", such as base 31 in FIG. 4 and base 30 in FIG. 5, strikes the surface 27 and is forced upwardly thereby. In FIGS. 1 and 4, the device 29 in moving upwardly, allows the arms 18 and 18A to resiliently flex inwardly and grasp the ball 27 therebetween in the depressions 28. In FIGS. 3 and 5, the device 29 is moved upwardly relative to the arms 18 and 18A to thereby spread the arms so that the ball 27 is released from the grasp of the arms.

An elongated elastic member 29A is secured at its opposed ends to the arms 18 and 18A, such that as seen in FIGS. 4 and 5, on one end thereof is secured to the arm 28, the other end is secured to the arm 18A and the intermediate portion overlies and engages the wide base 30. The elastic member 29A insures that the device 29 does not fall out from between the arms 18 and 18A as the arms move between the position shown in FIG. 4 to the position shown in FIG. 5. That is because, were it not for the elastic member 29A, when the device 29 is pushed up, as seen in FIG. 4, and the arms 18 and 18A rotate past 90 degrees toward the position shown in FIG. 5, the device 29 would be free to fall out. Guides G1 and G2 secured to the inner side of arm 18 on opposed sides of the device 29 and guides G3 and G4 secured to the inner side of arm 18A on opposed sides of the device 29 extend from top to the bottom of the arms and abut the device 29 fore and aft to prevent the device from tilting out of its operative position. An inclined chute 32 carried by the surface 17 supplies balls sequentially to a position wherein they can be grasped by the arms 18 and 18A. FIG. 3 shows the next ball 27A in a position to be grasped by the arms 18 and 18A in the next cycle. The chute can be filled with balls in one of many ways known in the prior art, et. by manually supplying them, hopper feed, and the like.

Figure 6:
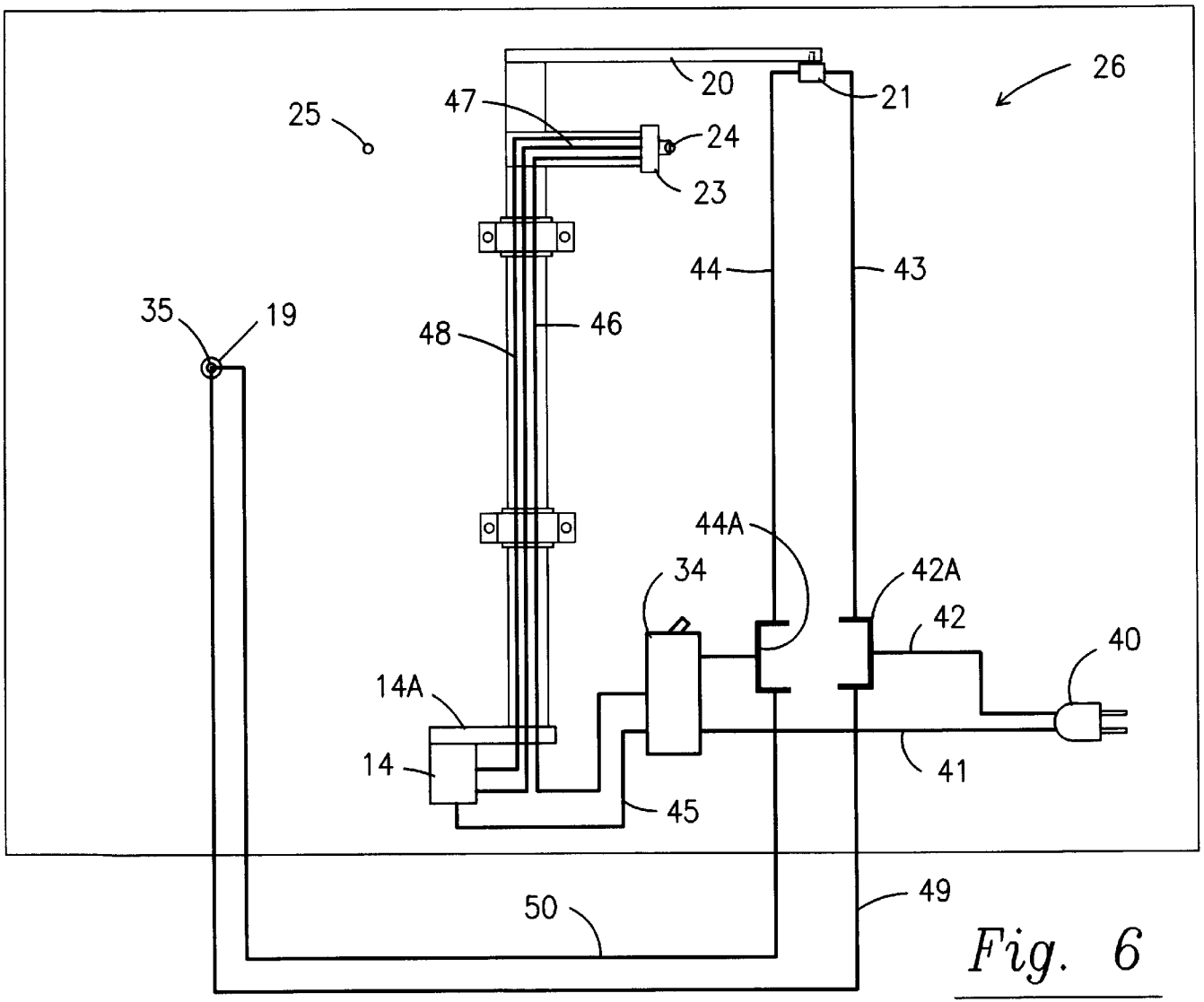
FIG. 6 is a schematic rendition of a control system for operating the device of FIGS. 1–5.

Referring now to FIG. 6, a control system is shown generally at 26 for the device of FIG. 1. A power plug 40, which is a source of operating 110 volt electric power, is connected, by a pair of lines 41 and 42 to the main power supply switch 34 for turning the entire system off and on. The line 42 is broken by a pair of double connectors 42A and 44A, so that absent another connection, power cannot flow from the plug 40 to the switch 34. To achieve such a connection, the double connectors 42A and 44A are connected respectively by lines 43 and 44 to the normally closed switch 21. Thus, at such time as the switch arm 20 is not in engagement with the switch 21, lines 42, 43 and 44 are connected so that power can flow from the plug 40 to the switch 34, and when the arm 20 actuates the switch 21 so that it moves to an open position, lines 43 and 44 are not connected. Similarly, the double connectors 42A and 44A are connected respectively, to lines 49 and 50 to the normally closed presence sensor in the form of a pressure switch 35 in the tee 19 and, when a golf ball is not present on the tee 19, the pressure switch will be closed and lines 42, 49 and 50 are connected so that power can flow from the plug 40 to the switch 34. When a golf ball is on the tee, the switch 35 is actuated to move to an open position and lines 49 and 50 are no longer connected. Thus the switch 21 cuts off power to the main switch 34 when the shaft 12 has rotated to place the arms 18 and 18A about the ball 27, and with a ball on the tee 19 the switch 35 is also open. When the operator strikes the ball 27 from the tee 19, the switch 35 closes and power is directed to the switch 34 there through and simultaneously through the switch 21 as soon as the arm 20 moves from engagement therewith.

Power from the main switch 34 to the motor 14 directly through a line 45 and an indirectly alternately through the line 46; which latter line connects to a forward and reversing toggle switch 23 which, in turn, is alternately connected to the motor 14 by the lines 47 and 48. As seen in FIGS. 1 and 6, when the arm 22 is in the ball pick up position, the switch 23 will engage the abutment 24 and move the switch 23 to a condition whereby line 46 is connected to line 47 and the motor 14 will be conditioned to rotate the shaft 12 counter clockwise from the position seen in FIG. 2 to the position seen in FIG. 3, and will so move upon power being supplied thereto. When the shaft 12 has rotated to the position shown in dotted lines in FIG. 1, and in FIG. 3; the switch will engage abutment 25 and be moved to a condition wherein the line 46 is connected to the line 48, and the motor 14 will be conditioned to rotate the shaft 12 clockwise from the position seen in FIG. 3 to that shown in FIG. 2.

Thus, when a ball is deposited on the tee 19 the shaft will still rotate clockwise until the arm 20 actuates switch 21 to send power to the motor. When the ball is knocked off the tee 19, power goes to the motor through switch 35, even though the arms 18 and 18A are in the ball pick up position and the switch 21 is open. Conversely, when the arms place the ball on the tee 19 and the switch 35 opens, the motor 14 rotation is reversed by the switch 23 and the motor still receives power from the switch 21 and continues to do so until a ball is on the tee to open switch 35 and the arm 20 engages switch 21 with the arms in a ball pick up position. When operation of the device is complete, the main switch 34 can be opened or the power plug 40 pulled to stop the device 10 from operating.

Figure 8:
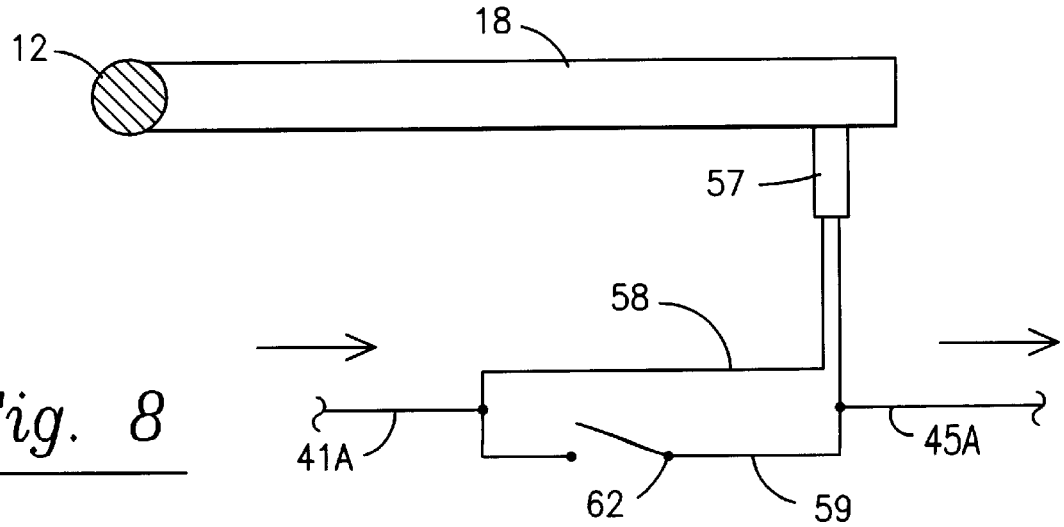
FIG. 8 is a schematic view of a sensor which turns off the device when the ball supply chute is empty.

Referring now to FIG. 8, wherein an automatic shut down circuit is shown which is also operable to stop the device 10 from operating, the arm 18 and 18A on the shaft 12, just before they are in the ball pick up position, are deflected outwardly by the spreading device 29. When the device 29 strikes the surface 17 and is moved upwardly, the arm 18 and 18A will attempt to move together; however, if a ball 27 is present therebetween the arms will remain apart. If no ball is present because the chute 32 is empty, the arms will move together and in this position, the arm 18 can engage the normally closed switch 57 to move the latter to an open condition and thereby prevent current from flowing to the motor 14 from the line 41A, which extends from the plug 40, through the now open switch 57 and then through the line 45A; the line 45A would replace the line 45 of the embodiment of FIG. 1 and the line 41A would replace the line 41. A start up switch is present to circumvent the open condition of switch 57 until such time as a ball is again present on the chute 32 to hold the arms 18 and 18A apart. More particularly, a normally open manually operable switch 62 is located in a by-pass line 59 between the lines 41A and 45A. Upon manually actuating the switch 62 to a closed position, power will be supplied to the line 45A and to the motor 14.

Figure 7:
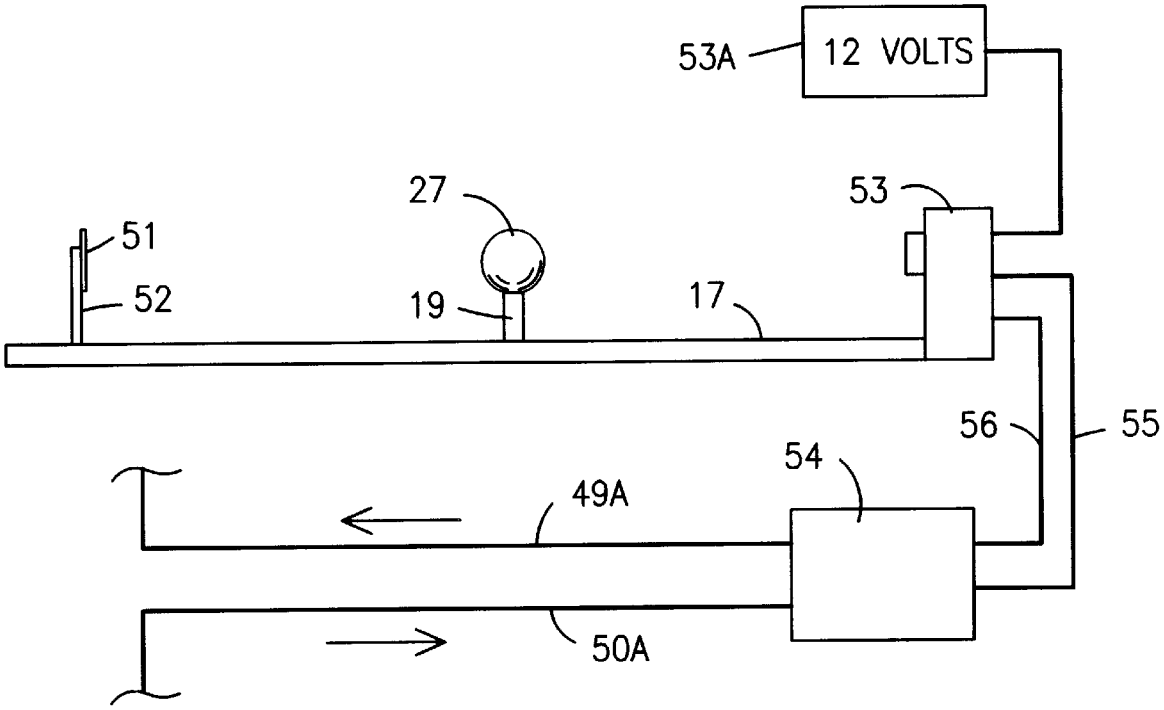
FIG. 7 is a schematic view of a modified, position sensor.

Referring now to FIG. 7, an alternate presence sensing device is shown at 53 which comprises an entry alert system which is available from Radio Shack. The sensing device 53 has a 12 volt source of power 53A and emits a beam which is directed to a reflector 51 supported on a post 52 fixed to the base 17. When the ball 29 is on the tee 19 it blocks the emission from the device 53 to the reflector 51 and no power from the 12 volt source leaves the device 53 through the lines 55 and 56. When the ball 27 leaves the tee 19, the emissions from the device 53 are reflected by the reflector 51 back to the device 53 and the latter becomes "closed" to thereby pass power to the 110 volt relay with a 12 volt coil. The relay then connects lines 49A and 50A into a conductive relationship. With the switch 35 omitted, the lines 49A and 50A are connected to the lines 49 and 50 respectively and, when the device 53 is "closed" passed current therebetween.

While only a single embodiment has been shown and described, it is apparent from the foregoing that many changes can be made therein without departing from the scope of this invention as claimed hereinafter.

What is claimed is:

1. A device for removing a golf ball from a ball supply and depositing the ball on a golf tee in repetitive cycles comprising in combination, a) a supporting surface including a golf tee and a source of balls spaced therefrom, b) a rotatable shaft including means mounting the same for rotation on said surface in a location intermediate said tee and said source of balls, 1) said shaft being rotatable between a first ball pick up position and a second ball deposit position, c) a forward and reverse electric motor drivingly connected to said shaft for rotating said shaft between its positions, d) a source of electric power for said motor including first conductor means and a main switch in said first conductor means for alternately connecting and disconnecting said source from said motor, e) a forward and reversing switch rotatable with said shaft and, upon rotation of said shaft to its ball pick up position, being actuated to condition said motor to rotate said shaft to its ball deposit position and, upon reaching said latter position, being operable to condition said motor to rotate said shaft to its ball pick up position, f) a first normally closed limiting switch rotatable with said shaft and including means operating the same to an open position when said shaft is in its ball pick up position, said first limiting switch moving to a closed position when said shaft is in other than said ball pick up position, said first limiting switch being operatively connected to said source of electric power for interrupting said source when open and for operatively connecting said source when closed, g) a presence sensing device operable as a normally closed second limiting switch and being in its closed condition at all times except when a ball is on said golf tee and in open condition when a ball is on said tee, said second limiting switch being operatively connected to said source of electric power for interrupting said source when open and for operatively connecting said source when closed, h) and grasping means rotatable with said shaft between a first position wherein said grasping means can grasp a ball from said source of balls and a second position wherein said grasping means can deposit a grasped ball on said tee, i) said grasping means having a first grasping position wherein it can grasp a ball, and a second position wherein it releases such a grasped ball from its grasp, and j) means for moving said grasping means to its first grasping position and said second position.

2. A device according to claim 1 wherein said presence sensing device is a normally closed pressure sensitive switch.

3. A device according to claim 1 wherein said presence sensing device is a normally closed device known as an entry alert system.

4. A device according to claim 1 including a normally closed switch which is actuated by said grasping means, and said grasping means is operative to actuate said switch to its open position when said grasping means is in its first position and there are no balls on said source of balls.

5. A device according to claim 1 wherein said grasping means are a pair of flexible and parallel arms made of a springy material and having a first and a second opposed ends with said first end connected to said shaft for unitary movement and said second end projecting therefrom, wedging means operatively connected to said arms to spread the projecting ends thereof when said projecting end are in their second position and for allowing said projecting ends to come together and grasp a ball therebetween from said source of balls when in said first position.

* * * * *